US006220468B1

(12) United States Patent
Lee

(10) Patent No.: US 6,220,468 B1
(45) Date of Patent: Apr. 24, 2001

(54) TOP AND BOTTOM CORNER LIFT FITTINGS FOR A CARGO CONTAINER

(75) Inventor: Sang Sig Lee, Chula Vista, CA (US)

(73) Assignee: Hyundai Precision America, Inc., San Diego, CA (US)

( * ) Notice: Subject to any disclaimer, the term of this patent is extended or adjusted under 35 U.S.C. 154(b) by 0 days.

(21) Appl. No.: 09/596,751

(22) Filed: Jun. 15, 2000

(51) Int. Cl.[7] ..... B65D 33/00
(52) U.S. Cl. ..... 220/1.5
(58) Field of Search ..... 220/1.5; 294/68.3, 294/67, 81

(56) References Cited

U.S. PATENT DOCUMENTS

| | | | | |
|---|---|---|---|---|
| 3,044,656 | | 7/1962 | Combs . | |
| 3,221,921 | | 12/1965 | Silverman . | |
| 3,386,600 | | 6/1968 | Betjemann . | |
| 3,456,829 | * | 7/1969 | Glassmeyer | 220/1.5 |
| 3,529,741 | | 9/1970 | Walker . | |
| 4,506,798 | | 3/1985 | Goutille . | |
| 4,558,797 | | 12/1985 | Mitchell . | |
| 4,844,672 | | 7/1989 | Yurgevich . | |
| 5,332,274 | * | 7/1994 | Baumann | 220/1.5 X |
| 5,348,175 | | 9/1994 | Reynard . | |
| 5,449,082 | | 9/1995 | Reynard . | |
| 5,573,293 | * | 11/1996 | Baumann et al. | 220/1.5 X |
| 5,782,519 | * | 7/1998 | Baumann | 220/1.5 X |

* cited by examiner

*Primary Examiner*—Steven Pollard
(74) *Attorney, Agent, or Firm*—Baker & McKenzie

(57) ABSTRACT

A lift fitting for cargo containers. The lift fitting can be constructed as an intermediate lift fitting to be positioned inboard from the corners of the container. The lift fitting defines a hollow body member with apertures for receiving lifting such as a crane arm or coupling devices such as twist locks. The lift fitting also has an extension on an outside surface for attachment to the cargo container to maintain the integrity and geometry of the container and to minimize the number of welds and the associated construction costs. In a particular example, the lift fitting has both a horizontal extension and a vertical extension for attachment to a cargo container.

22 Claims, 13 Drawing Sheets

FIG. 22
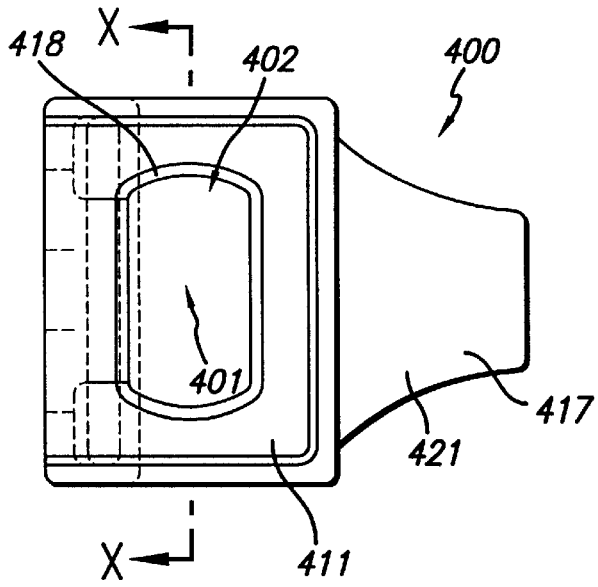
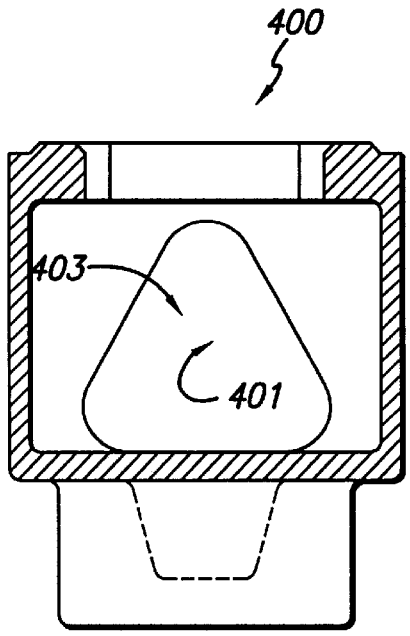
FIG. 23
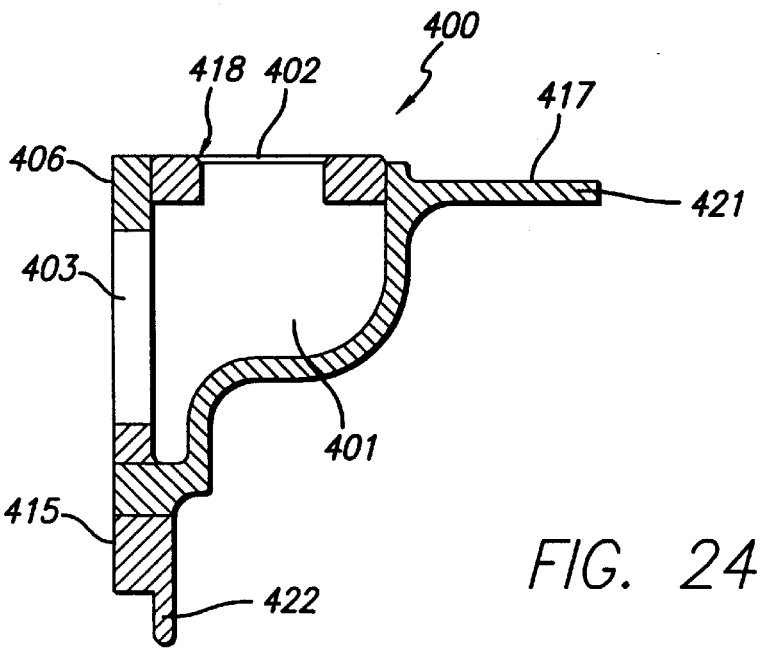
FIG. 24

TOP AND BOTTOM CORNER LIFT FITTINGS FOR A CARGO CONTAINER

FIELD OF THE INVENTION

The present invention relates to lift fittings for cargo containers. More particularly, the invention relates to top and bottom corner fittings.

BACKGROUND OF THE INVENTION

Cargo containers are commonly used to transport goods on ships, trains, and trucks. These cargo containers must be lifted and moved as they are transported. Lifting devices, such as mechanical cranes, are used to grapple and position the cargo containers. To ease coupling the lifting device to the cargo container, the cargo container may be provided with lift fittings. These fittings may be positioned in, for example, the upper or lower corners of the cargo container. Further, as the cargo container and its load may be extremely heavy, the fittings may be positioned in a reinforced area. The fittings each have at least one aperture that receives a mating portion of the lifting device. Once secured into the apertures of the fittings, the lifting device can lift and move the cargo container.

When the cargo container is in transport or storage, it may be desirable to secure the cargo container into a stable position. Therefore, locking mechanisms may be used to engage the apertures to secure the container during transport or storage. The apertures are adapted to accept lifting or locking mechanisms and to withstand the forces imposed during movement and transport.

Because cargo containers are used to transport goods throughout the United States and worldwide, national and international standards have been established for such lift fittings. For example, ISO specification 1161 provides that the fittings will be generally box-shaped without any sharp corners. Furthermore, there must be at least four fittings on the top and at least four fittings on the bottom, generally positioned at the end corners of the cargo container. Each fitting on the top should have at least one aperture on each of the exposed top, side, and end surfaces. Similarly, the fittings along the bottom edges of the cargo container should have at least one aperture on each of the exposed bottom and side surfaces.

Another typically standardized characteristic is the distance between the fittings. Containers of standard size have fittings located in the end corners, thus benefiting from the strength of the three intersecting walls at an end corner for support. Another typical standardized characteristic is the width distance between apertures of the fittings. For example a typical North American type domestic cargo container is 102⅜ inches wide, with fittings positioned in the top end corners. The aperture for each fitting is centered approximately 6 11/16 inches from each sidewall. In such a manner the center of a pair of apertures are spaced apart by approximately 89 inches.

However, some cargo containers are longer than the standardized lengths allowing higher-volume payloads that reduce transportation costs. These longer cargo containers generally still have four top and four bottom fittings positioned in the end corners and are approximately 102⅜ inches wide. However, the longer cargo containers also should have fittings inboard from the ends. For example, the Association of American Railroads Specification M930 specifies that cargo containers over 40 feet in length must also have four top and four bottom intermediate corner fittings positioned 40 feet apart. These fittings are attached into frames that support the loads imposed during transportation.

Many known lift fittings are difficult to manufacture, requiring the joining of parts by welding. This suffers a deficiency of substantial time and costs for production. Many known lift fittings require numerous welds to create the frame of the cargo container. This welding is also undesirable because it increases the time and costs of manufacture.

Furthermore, many known lift fittings need bulky vertical supports, creating cargo containers with non-smooth sidewalls. Smoother sidewalls are desirable because they can allow higher volume cargo payloads. Furthermore, smoother sidewalls increase the durability of the cargo container by reducing the damage caused by objects catching the edges of a non-smooth sidewall.

Accordingly, there is a need for a lift fitting that is economical to manufacture, but strong enough to survive the rigors of transportation, including lifting, stacking, and racking. There is also a need for an a lift fitting that allows the construction of cargo containers with sufficient strength but with fewer welds to reduce production costs. Furthermore, there is a need for an a lift fitting that allows the construction of a cargo container with substantially smooth sidewalls.

SUMMARY OF THE INVENTION

The present invention alleviates to a great extent the above noted and other disadvantages of the known lift fittings by providing a lift fitting that allows the securing and lifting of cargo containers preferably using a single casting for each lift fitting.

In a preferred embodiment, a lift fitting includes a body element defining a chamber. The body has at least one aperture on each of the exposed vertical and horizontal surfaces communicating with the chamber to permit the engagement of locking elements within the chamber.

The body of a preferred embodiment has a vertical extension depending from the inner horizontal surface for attachment to a vertical support post of the cargo container. The vertical extension has integrated steps on its outside face, designed to attach to a vertical support post. These steps on the outside face of the vertical extension position and secure the vertical support. The junction between vertical support post and the stepped vertical extension of the intermediate fitting preferably is sufficiently strong and stable to allow connection with a single weld, or a small number of welds. Furthermore, the present invention allows the use of plug welds that strengthen the connection but are easy to apply.

In a disclosed example of the lift fitting, the body of the lift fitting has both a vertical extension and a horizontal extension. The extensions may be in the form of weld flanges to be welded to a cargo container. Accordingly, the lift fitting may be conveniently and securely attached to a cargo container.

In another aspect of a preferred embodiment, top corner fittings are constructed such that the center of the top aperture of each fitting is positioned approximately 3 inches from the sidewall of the cargo container. Thereby, the centers of the apertures for a pair of top corner lift fittings are spaced apart by approximately 96⅜ inches. By spacing the apertures closer to the cargo container sidewalls, stress and deformation is minimized during lifting. These and other features and advantages of the present invention will be appreciated from review of the detailed description of the invention, along with the accompanying figures in which like reference numerals refer to like parts throughout.

BRIEF DESCRIPTION OF THE DRAWINGS

The FIG. 20 is a cross sectional perspective view of a lift support made in accordance with the present invention.

FIG. 22 is a top view of the lift support shown in FIG. 21;

FIG. 23 is a cross-sectional view of the lift support shown in FIG. 21 taken along line X—X of FIG. 22; and FIG. 24 is a cross-sectional view of the lift support shown in FIG. 21.

DETAILED DESCRIPTION OF THE INVENTION

As illustrated in the figures, a lift fitting 10 is provided. Although an intermediate corner lift fitting is a preferred embodiment and is discussed in this description for purposes of illustration, it should be understood that other forms of cargo container fittings such as end corner fittings or other top or bottom fittings may also be made in accordance with the invention. The illustrated intermediate corner fitting 10 is generally positioned inboard from the corners of a cargo container 5.

Figure 1:
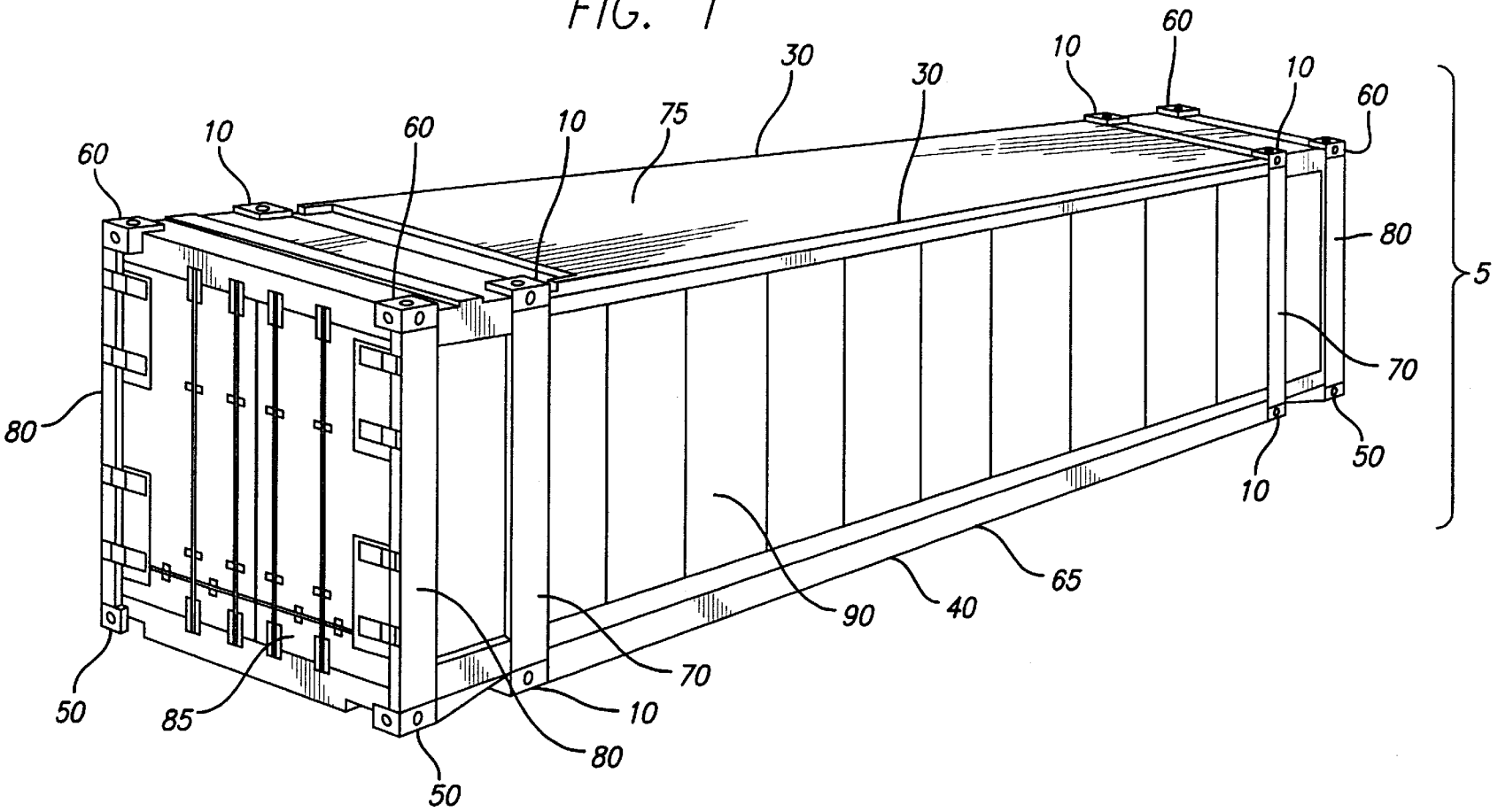
FIG. 1 is an illustration of a cargo container in accordance with the present invention.

FIG. 1 schematically illustrates cargo container 5. The cargo container 5 is a generally rectangular box-like structure with a support frame formed by upper-horizontal corners, or edges 30, lower-horizontal corners, or edges 40 and vertical supports 80. It will be understood that other shapes of cargo containers may be used. FIG. 1 illustrates the cargo container 5 with a plurality of sides 90, a top 75 and a bottom 65 with at least one end of the container serving as an access door 85. Alternatively, cargo container 5 may have a storage structure positioned within the support frame. A top end corner fitting 60 is positioned at each upper end corner of the cargo container 5, secured at the corner intersections of upper-horizontal edge 30 and vertical edge 80. Similarly, a bottom corner fitting 50 is positioned at each lower corner of cargo container 5, secured to the intersection of lower-horizontal edge 40 and vertical edge 80.

The cargo container illustrated in FIG. 1 also includes plural intermediate corner fittings 10 positioned on edges of the cargo container 5, but inboard from the ends of the container, i.e., between the end corners. In a preferred embodiment, two intermediate corner fittings 10 are positioned on each upper horizontal corner or edge 30 and each lower horizontal corner, or edge 40, although it should be understood that any number of intermediate corner fittings 10 (or none) may be used. Thus, in the preferred embodiment there are four intermediate corner fittings 10 on the top of the cargo container and four on the bottom. In one embodiment, multiple pairs of the intermediate fitting 10 are positioned on each horizontal edge. Alternatively, intermediate fittings 10 may be positioned along the bottom of cargo container 5, but not on top.

In a preferred embodiment, intermediate fittings 10 are positioned 40 feet apart (or at any other standardized distances). With this construction, a double end frame cargo container 5 of a standard or a non-standard length may be positioned and secured with generally available equipment adapted to handle standard length cargo containers. However, it should be appreciated that the pairs of intermediate fittings 10 can be other distances apart.

In fabrication, an intermediate corner fitting 10 can be positioned and affixed to upper-horizontal edge 30 and preferably to a vertical support 70 which extends from an intermediate fitting 10 to an opposing intermediate fitting 10; i.e., from a top-side intermediate fitting to a bottom-side intermediate fitting. In turn, this second intermediate fitting 10 is positioned and affixed to lower-horizontal edge. Welds are generally used to create strong, permanent connections. Alternatively, the intermediate fitting 10 may be attached using adhesives, fastening mechanisms such as nails or bolts, or any other means to create strong connections.

Figure 2:
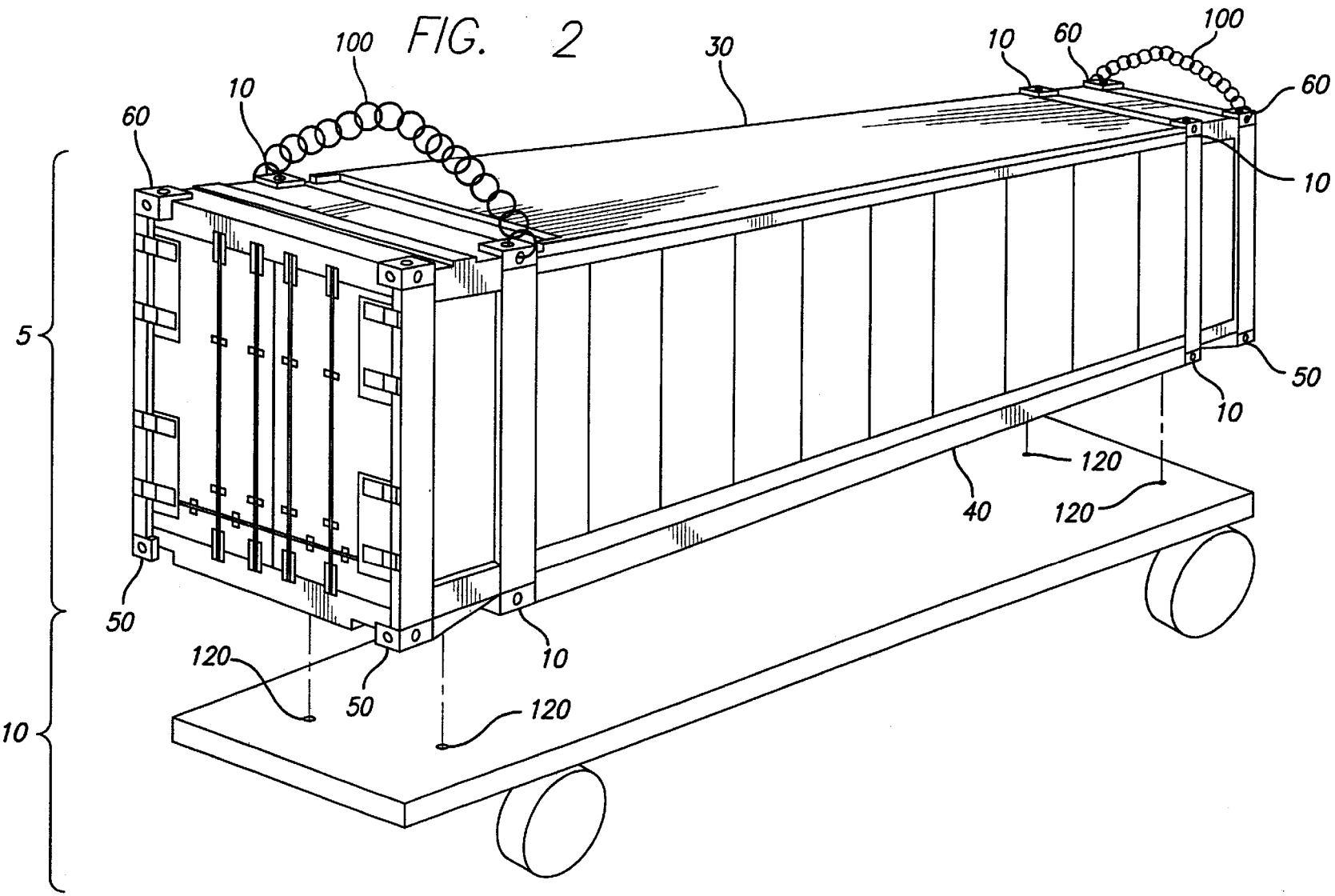
FIG. 2 is an illustration of a cargo container in accordance with the present invention FIG. 1 being positioned secured to a transport vehicle.

As illustrated in FIGS. 1 and 2, the intermediate fitting 10 preferably has at least one aperture on each exposed vertical and horizontal surface. FIG. 2 illustrates the importance of intermediate fitting 10 and its apertures. In use, a cargo container 5 is typically handled using a lifting device 100 such as can be found in ports, railroad yards and other transport facilities. Lifting device 100 is typically a crane assembly having four depending lifting arms that can be positioned over the cargo container 5. Lifting device 100 generally includes a grappling assembly, including some type of hook or extension that mates with an aperture of the fitting.

To lift the cargo container 5, the lifting device 100 is positioned over the cargo container 5. The lifting device 100 then can engage intermediate corner fittings 10 to position and move cargo container 5. The lifting device 100 commonly optionally may have grappling positions such as grasp jibs, projecting arms, which engage apertures of the intermediate fittings 10. Generally but not necessarily, the lifting device 100 will engage the apertures on the top surface of the cargo container 5. Thus, these apertures on the top surfaces of the cargo container are generally tapered to help guide the grappling portions of the lifting device 100.

Once the lifting device 100 grapples a fitting 10, the lifting device can be operated to position the cargo container 5 in any desired fashion. For example, FIG. 2 illustrates the cargo container 5 being loaded onto a transport vehicle 110. While FIG. 2 illustrates transport vehicle 110 as a truck, transport vehicle 110 could be any means of transporting the cargo container 5, such as a plane, train, ship or any other desired transport.

FIG. 2 also illustrates the use of intermediate fitting 10 in attaching cargo container 5 to a transport vehicle 110 once the cargo container 5 is properly positioned in the procedure described above. The transport vehicle 110 generally contains at least one coupling device 120 that is mated in an aperture of the intermediate fitting 10. The coupling device 120 enters and engages an aperture in the intermediate fitting 10. In this way, the coupling device 120 secures the cargo container 5 to the transport vehicle 110 via the intermediate fitting 10 during transport and storage.

Alternatively, the coupling device 120 is used to connect two or more cargo containers 5. For example, two or more cargo containers 5 may be connected end-to-end, side-to-side, or top-to-bottom. In this way, multiple cargo containers 5 may be transported on the same transport vehicle 110. This method of connecting cargo containers 5 is used during transport of the cargo containers, such as on ships. Furthermore, connecting together multiple cargo containers 5 helps prevent damage to the cargo containers 5 and their cargo caused by shifting during transportation.

The coupling device 120 is commonly a twist-lock, but other coupling devices also may be used. A twist lock has a lever arm connected to a generally oval-shaped appendage designed to enter an aperture of the intermediate fitting 10. After the twist lock is inserted into an aperture of intermediate fitting 10, force is applied to the lever arm. This force can either be applied manually by workers or applied mechanically by a machine designed to torque the lever arm. Upon application of force to the lever arm, the twist lock turns so that the long axis of the oval appendage engages the interior chamber of the intermediate fitting 10.

Clamps are also commonly used as coupling devices 120. Often, the coupling device 120 attaches to an intermediate fitting 10 along the bottom surface of cargo container 5, but the coupling device 120 may be used on any intermediate fitting 10, or on any corner fitting. For example, a first cargo container 5 may be placed over a second cargo container 5 by connecting the bottom of the first cargo container 5 to the top of the second cargo container 5 via the intermediate fittings 10.

An intermediate corner fitting 10 in accordance with the present invention should be described in greater detail. The intermediate fitting 10 preferably is formed of a metallic material and preferably steel. However, the intermediate fitting 10 may be composed of any material of sufficient strength. For example, the intermediate fitting 10 may be constructed from metal alloys, wood, carbon fiber, or ceramics.

Figure 3:
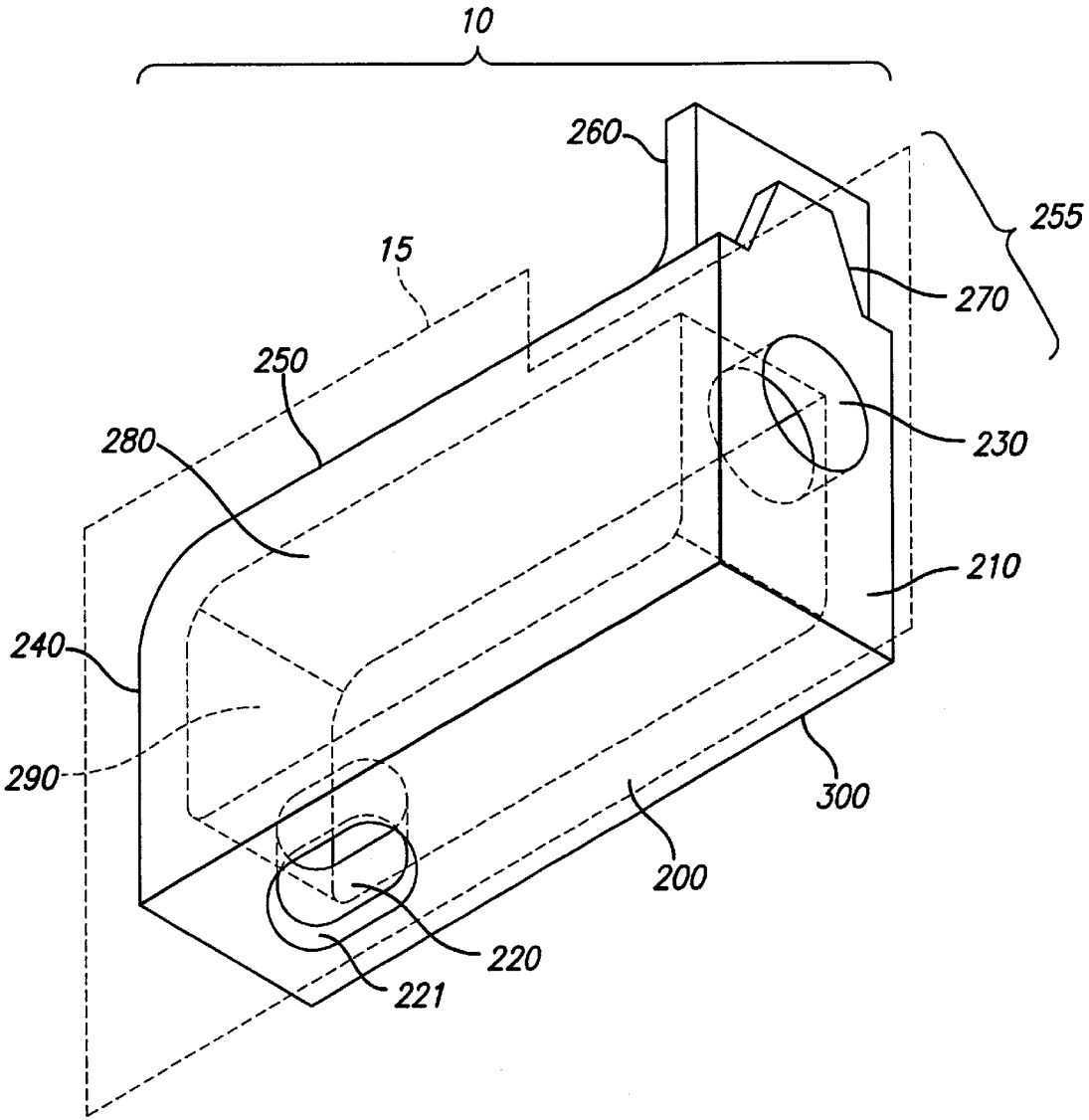
FIG. 3 is a bottom perspective view of an intermediate fitting in accordance with the present invention.

Referring now to FIG. 3 the intermediate fitting 10 is shown having a body 15 that includes an outer vertical wall 210, an inner vertical wall 240, sidewalls 280 and 300, an inner horizontal wall 250, and an outer horizontal wall 200. The body 15 of the intermediate fitting 10 defines a hollow interior chamber 290. A horizontal aperture 220 communicates with the hollow interior chamber 290 through the outer horizontal wall 200, allowing access to the interior chamber 290. A side aperture 230 communicates with chamber 290 through outer vertical wall 210 also allowing access to interior chamber 290. The intermediate fitting 10 also preferably has a vertical extension 255 that depends from inner horizontal wall 250. Vertical extension 255 has an inner surface 260 and an outer surface 270.

In the preferred embodiment, the intermediate fitting 10 is formed by casting, thereby constructing a one-piece cast construction. Forming the intermediate corner fitting 10 as a one-piece casting is desirable because casting is relatively inexpensive compared to other processes that combine separate parts, such as welding, gluing or riveting. Furthermore, producing the fittings 10, 60 by casting can result in enhanced strength and wear resistance, compared with producing the fittings by combining separate parts. It should be appreciated, however, that the fittings 10, 60 can also be formed by attaching component parts using various attachment means such as welds, adhesives, screws, nails, bolts, etc., as well.

Figure 4:
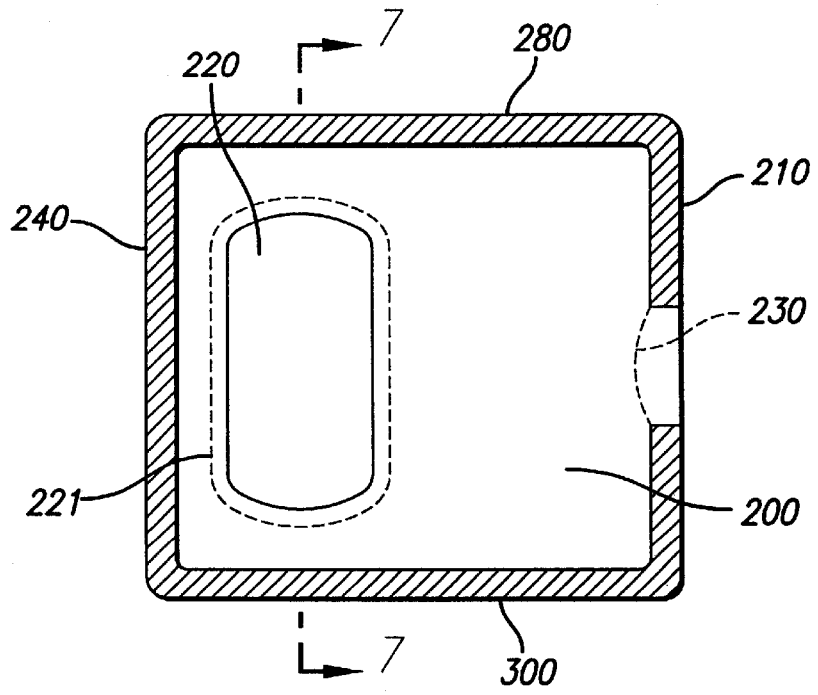
FIG. 4 is a cross-sectional view of the intermediate fitting of FIG. 3 taken along line 4—4 of FIG. 6.
Figure 5:
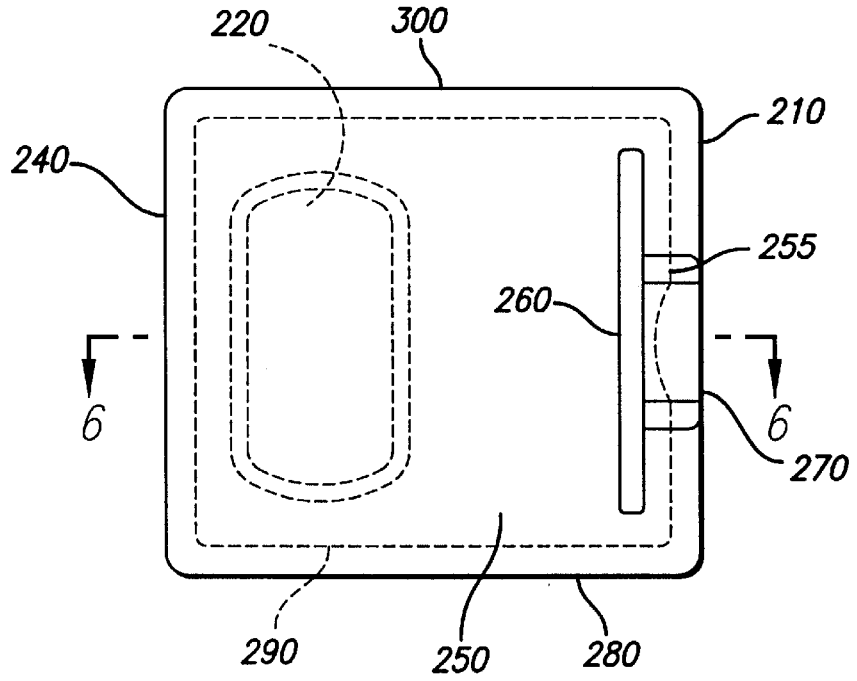
FIG. 5 is a bottom view of an intermediate fitting in accordance with the present invention.
Figure 6:
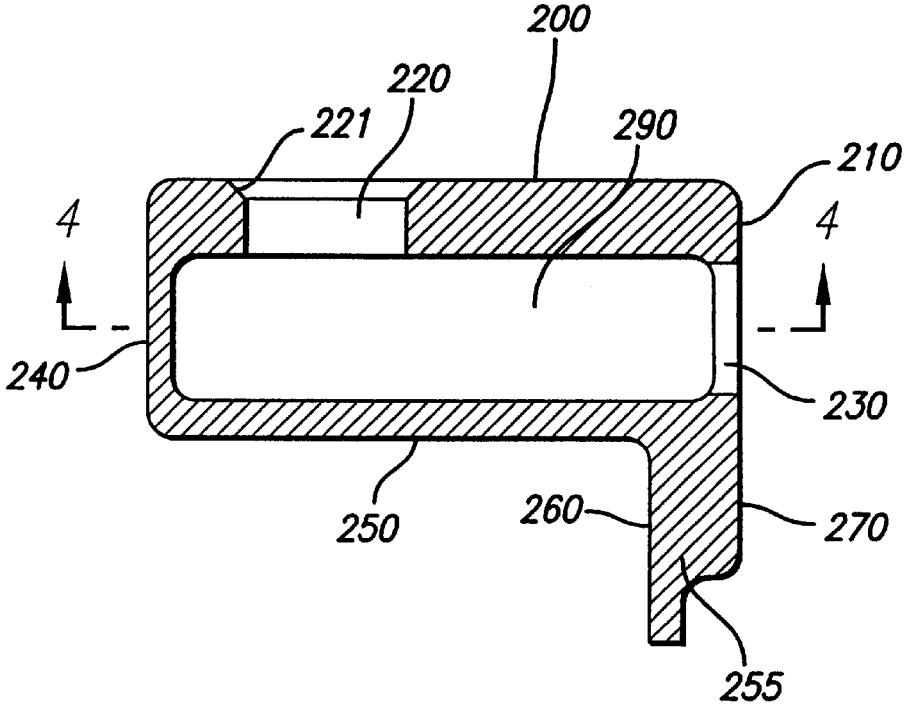
FIG. 6 is a cross-sectional view of an intermediate fitting in accordance with the present invention taken along line 6—6 of FIG. 5.

Horizontal aperture 220 is illustrated by FIGS. 4 and 6. The horizontal aperture 220 may have any shape but is preferably semi-round or oval-shaped to allow easy application of the lifting device 100 and coupling device 120. ISO 1161 requires that horizontal aperture 220 taper so that the radius of the horizontal aperture at the outside surface of outer horizontal wall 200 is greater than the radius at the inside surface. This tapering 221 allows the lifting device 100 and coupling device 120 to easily access interior cavity 290 while preserving the strength of intermediate fitting 10.

Figure 7:
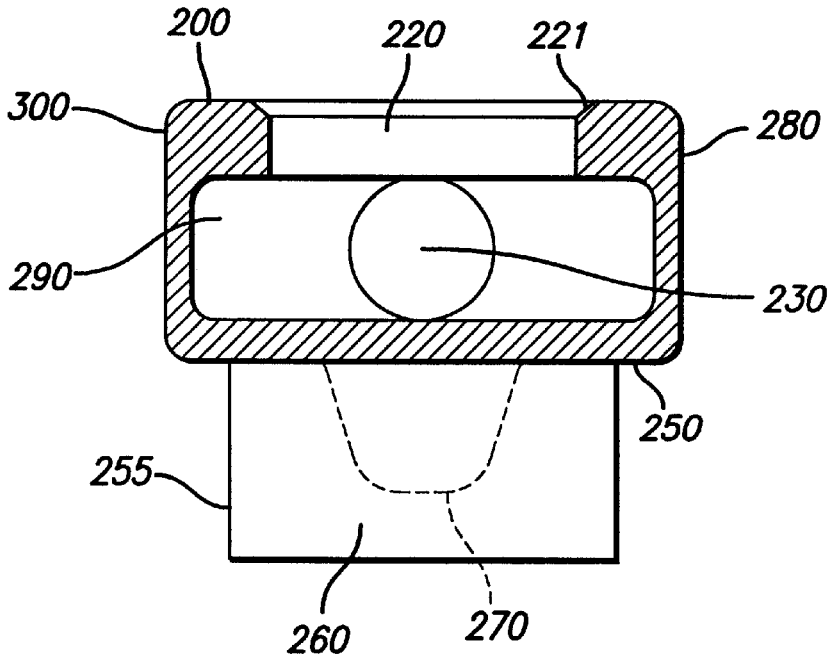
FIG. 7 is a cross-sectional view of an intermediate fitting in accordance with the present invention taken along line 7—7 of FIG. 4.

FIGS. 6 and 7 illustrate the characteristics of the vertical aperture 230. The vertical aperture 230 may have any shape but is preferably round or oval shaped to allow easy application of the lifting device 100 and coupling device 120. Unlike horizontal aperture 220, vertical aperture 230 generally is not tapered. In a preferred embodiment, the vertical aperture 230 has a diameter that corresponds to the height of the interior cavity 290.

Figure 8:
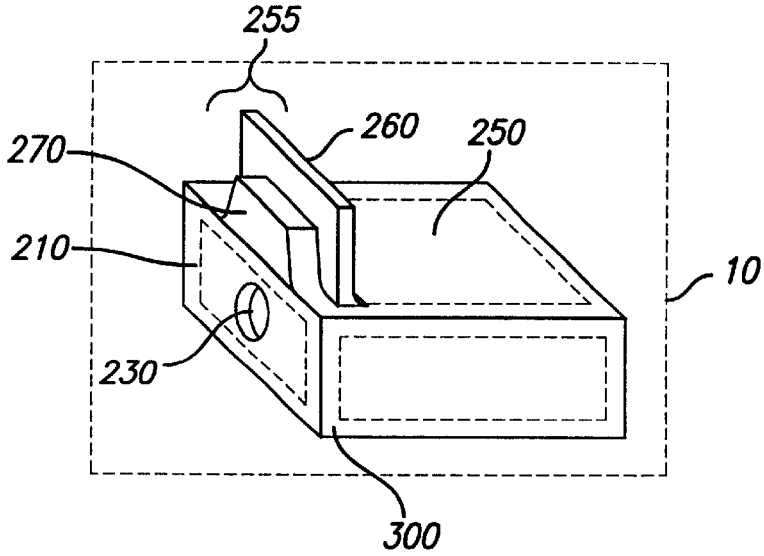
FIG. 8 is a top perspective view of an intermediate fitting in accordance with the present invention.

FIGS. 3 and 8 illustrate the vertical extension 255. The vertical extension 255 has an inner extension surface 260 and outer extension surface 270. Vertical extension 255 depends from inner-horizontal wall 250. The inner extension surface 260 and the outer extension surface 270 are generally planer. Furthermore, the outer extension surface 270 is generally flush and planer to the exterior surface of the outer vertical wall 210.

As illustrated in FIG. 8, the outer extension surface 270 is shorter than inner extension surface 260, creating a vertical step. Furthermore, the outer extension surface 270 is generally narrower then inner extension surface 260, thereby creating a horizontal step on each side of outside extension surface 270 of the vertical extension 255. In a preferred embodiment, the outer extension surface 270 also tapers to become narrower away from the body 15. Thus, the vertical steps become increasingly larger away from the body 15.

Figure 9:
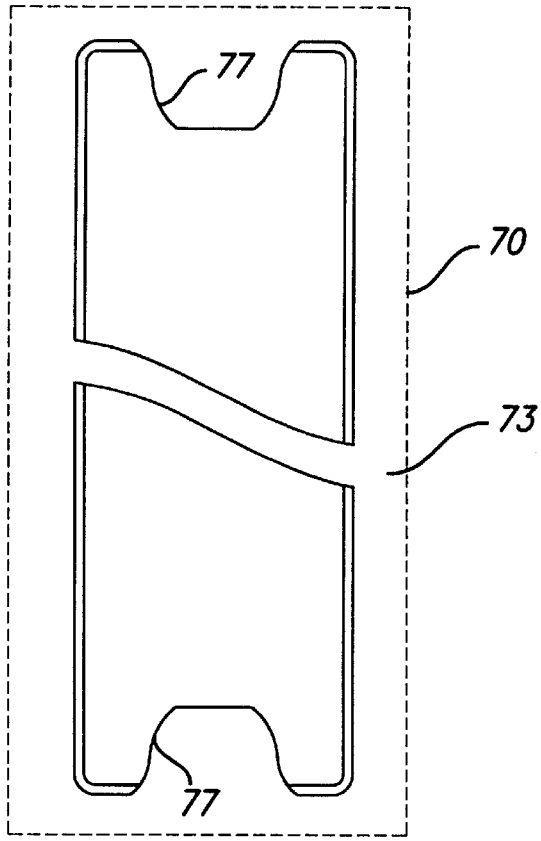
FIG. 9 is an illustration of a vertical support used with an intermediate fitting in accordance with the present invention.
Figure 10:
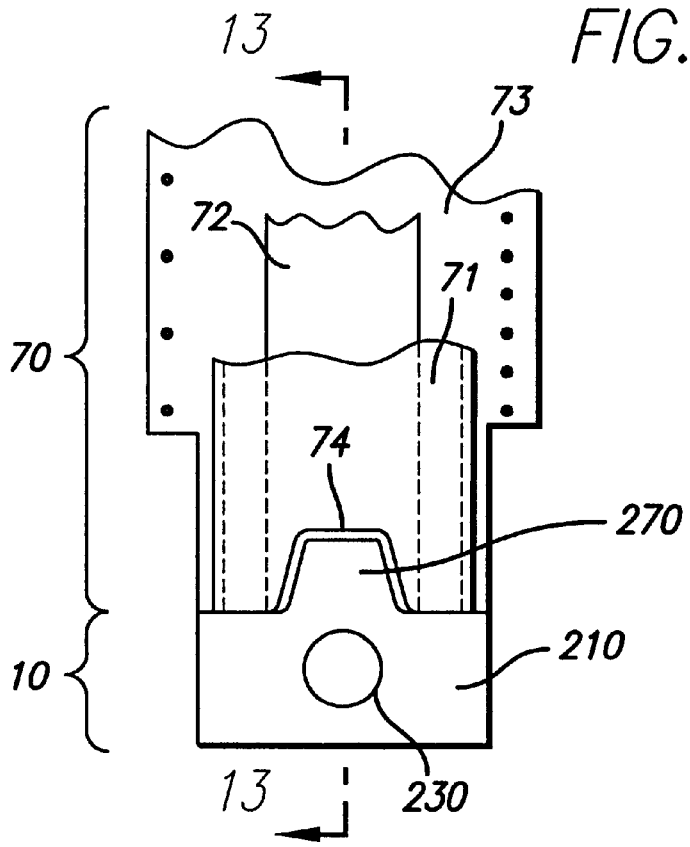
FIG. 10 is an illustration of a vertical support positioned on an intermediate fitting in accordance with the present invention.

The importance of the vertical and horizontal steps of the outside extension surface 270 can be seen in FIG. 10, which illustrates the connection of intermediate corner fitting 10 to the vertical support 70. A preferred embodiment of the vertical support 70 has a cutout 74 adapted to accept the shape of outer extension surface 270 created by the steps of the vertical extension 255. Furthermore, vertical support 70 may contain two cutouts 77, as illustrated in FIG. 9, to allow connections to intermediate corner fittings 10 located on the top and bottom, 65 and 75, of cargo container 5.

Figure 11:
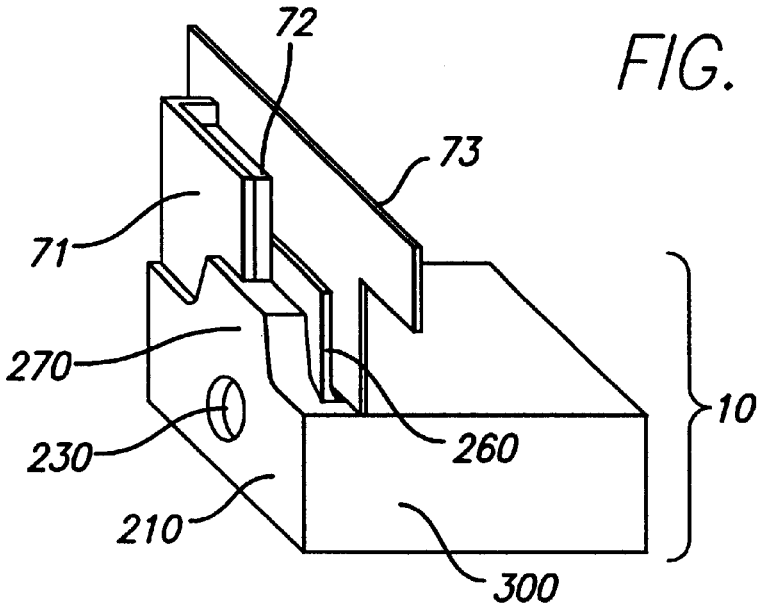
FIG. 11 is a front perspective view of a vertical support positioned on an intermediate fitting in accordance with the present invention.

FIGS. 10 and 11 illustrate a preferred embodiment of vertical support 70. In particular, the vertical support 70 contains an outer support wall 71, an inner support wall 73, and a reinforcement 72. Outer support wall 71 and reinforcement 72 are adapted to engage the outer extension surface 270. This engagement positions and secures vertical support 70 to the intermediate fitting 10. In contrast, the inner support wall 73 fits on inner extension surface 260.

Figure 12:
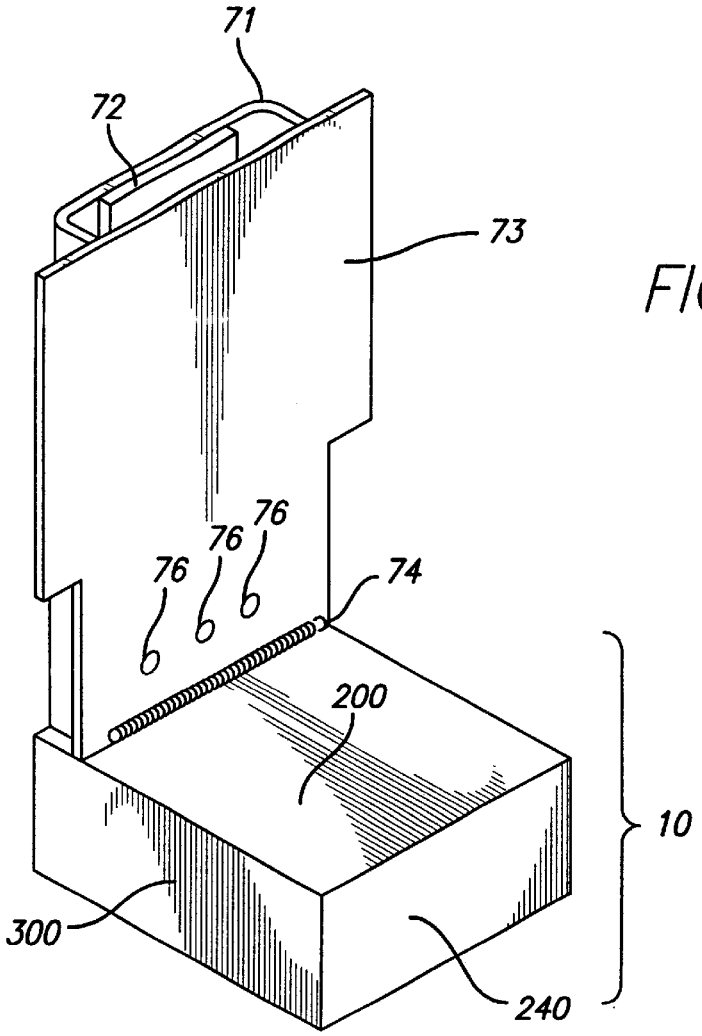
FIG. 12 is a rear perspective view of a vertical support positioned on an intermediate fitting in accordance with the present invention.
Figure 13:
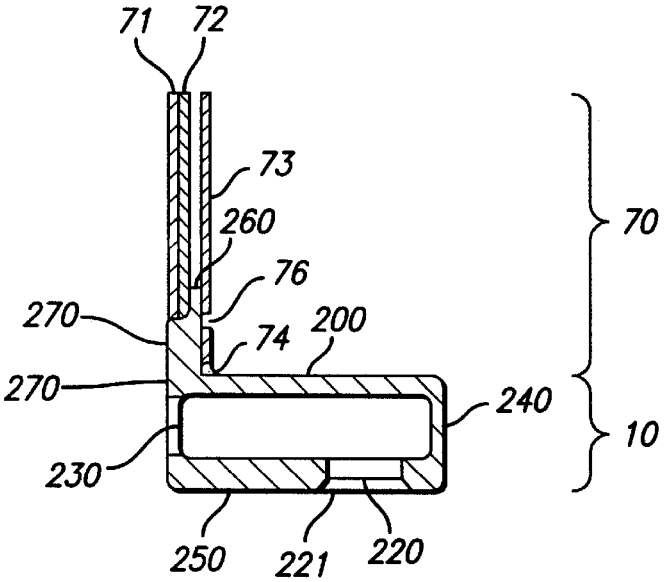
FIG. 13 is a cross-sectional view of a vertical support and an intermediate fitting in accordance with the present invention taken along line 13—13 of FIG. 10.

In a preferred embodiment illustrated in FIGS. 12 and 13, vertical support 70 is attached to intermediate fitting 10 by welding inner support wall 73 to the inner horizontal surface 200. Additionally, one or more plug welds 76 can connect inner support wall 73 to inner extension surface 260. As illustrated in FIG. 13, the plug weld 76 generally enters below the horizontal step of the vertical extension 255 to allow the plug weld 76 to engage the thickest section of the vertical extension 255. For maximum strength, the vertical support 70 sandwiches the vertical extension 255, as illustrated in FIG. 13. Thus, the vertical extension 255 allows the connection of intermediate fitting 10 to support 70 with comparatively less welding than required for adequate support using known conventional fittings. This structure also allows a single intermediate corner fitting 10 and a single support 70 to combine, forming a strong structure without employing multiple support posts.

Generally, vertical support 70 is metal, and preferably steel. Alternatively, the vertical support 70 can be wood, plastic, ceramic or any other material with sufficient strength and the desired characteristics for use in cargo container 5. In a preferred embodiment, vertical support 70 is a one-piece casting. This form of production maximizes the strength of the vertical support 70 while simultaneously minimizing production costs. Alternatively, vertical support 70 is formed by combining its component parts, 71, 72 and 73, through welding, adhering, bolting or other processes.

Outer and inner support walls, 71 and 73 are generally planer. In particular, it is preferable that inner support wall 73 is substantially planer to allow the construction of a cargo container 5 with a substantially smooth side 90. Furthermore, inner support wall 73 preferably contains substantially planer flanges that extend outwards to allow connection of the inner support wall 73 to the side 90 of the cargo container. The inner support wall 73 is generally bolted to the side 90, but alternatively could be welded or adhered.

Intermediate fitting 10, having vertical extension 255, when secured to vertical support 70 in the manner described, ensures the integrity of a cargo container of non-standardized length. The stress and load factors are disbursed throughout vertical support post 70.

Figure 14:
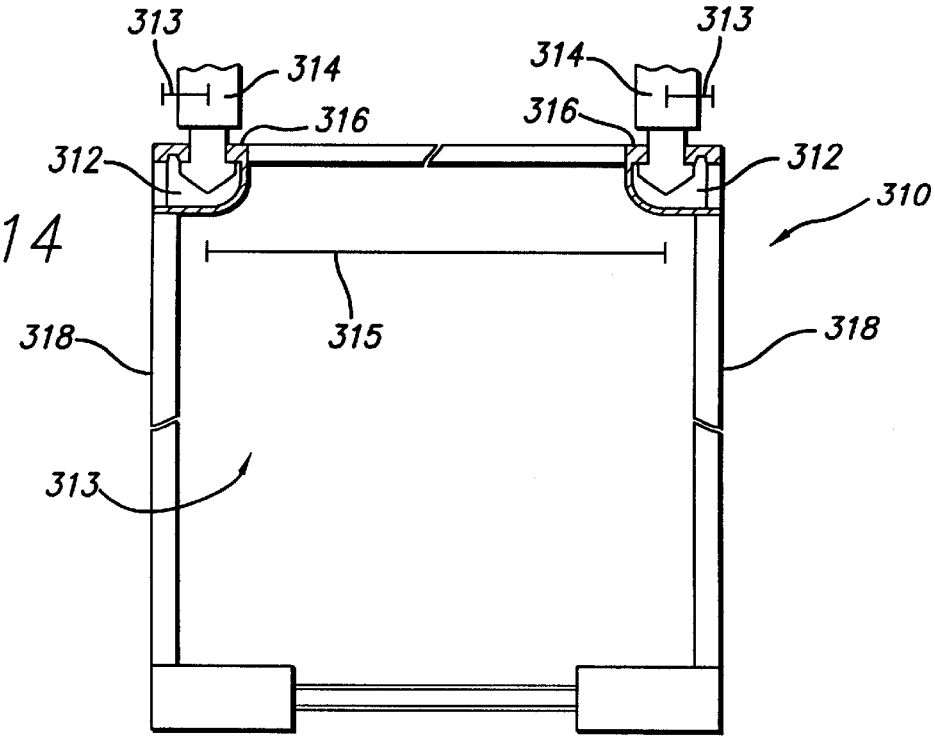
FIG. 14 is a partial cross-sectional view of a cargo container made in accordance with the present invention.

FIG. 14 shows another corner lift fitting made in accordance with the present invention. FIG. 14 shows a cargo container 310 being lifted by lifting device 314. Lifting device 314 couples to cargo container 310 at corner lift fittings 312. Corner lift fittings 312 are positioned on cargo container 310 so that the apertures 316 of the fittings 312 align with the lifting device 314. As described above, corner lift fittings 312 may be configured as end corner fittings or intermediate corner fittings. Further, lift fittings 312 may be constructed for use on either the top or the bottom corner of the cargo container.

The cargo container 310 has a standard width of approximately 102⅜ inches. The fittings 312 are constructed and spaced apart such that the center of the apertures 316 are spaced approximately 96⅜ inches apart 315. In such a manner the center of each aperture 316 is positioned approximately 3 inches 313 from the edge of the cargo container 310. It will be understood that the specific spacing dimension may be adjusted to meet application requirements.

Figure 15:
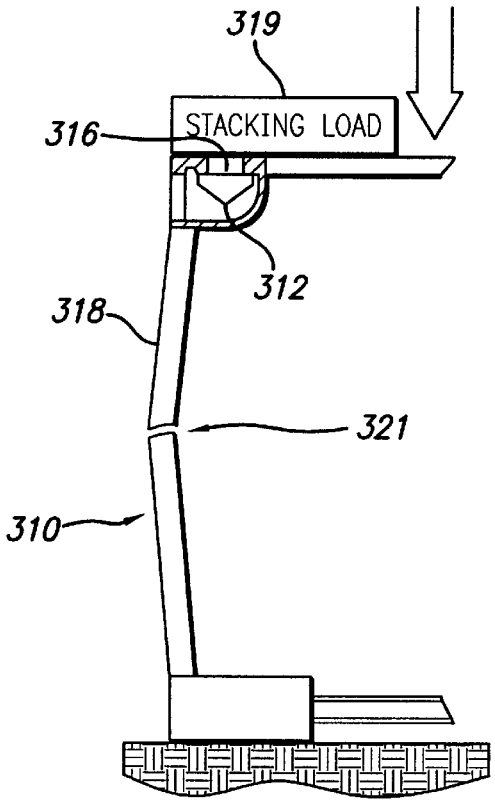
FIG. 15 is a partial cross-sectional view of a cargo container made in accordance with the present invention.

Referring to FIG. 15 the cargo container 310 is shown under the stress of stacking load 319. As the weight of the stacking load 319 acts on the sidewall 318 and fittings 312, the stacking load 319 causes the side wall 318 to be stressed and to deform. However, the fitting 312 is positioned closely to the outside of the side wall 318. Therefore, the fitting 312 acts to reinforce the sidewall and to reduce any angular force from the fitting 312 acting on the sidewall. Accordingly, the load 319 causes minimized stress and deformation to the sidewall. Further, when the lifting device 314 is fully engaged in the fitting 312 and the cargo container 310 is being lifted, an angular force 313 also acts to stress and deform the side wall 318. However, as the lifting device 314 is centered only approximately three inches from the outside of the sidewall 318, the stress and deformation caused by the force 313 is reduced, as compound to container having known fittings.

Figure 16:
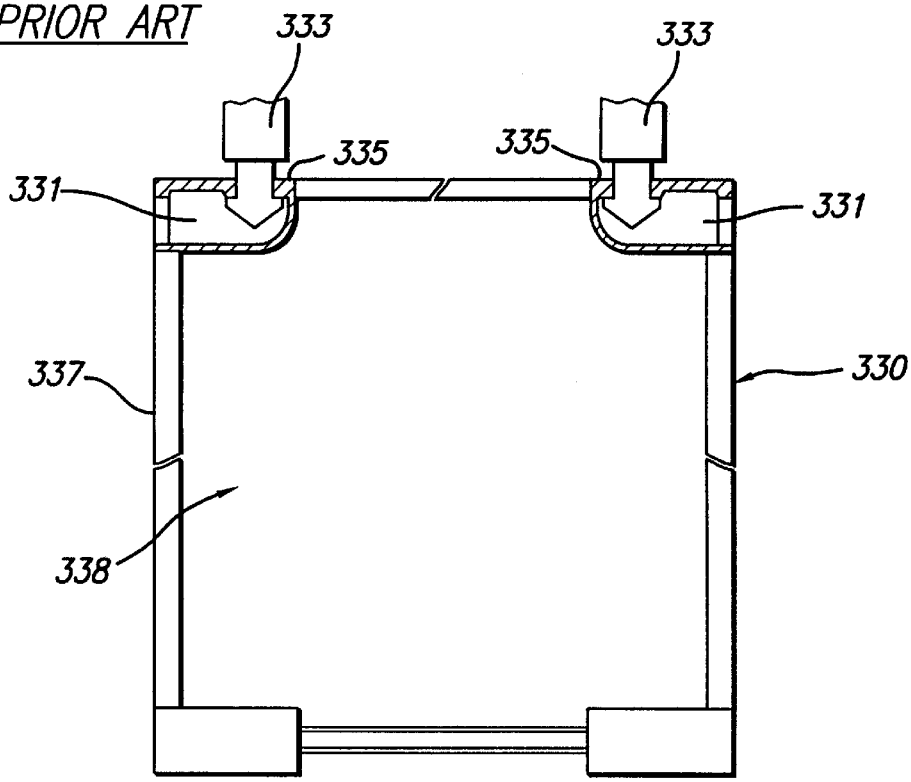
FIG. 16 PRIOR ART
FIG. 16 is a partial cross-sectional view of a known cargo container.
Figure 17:
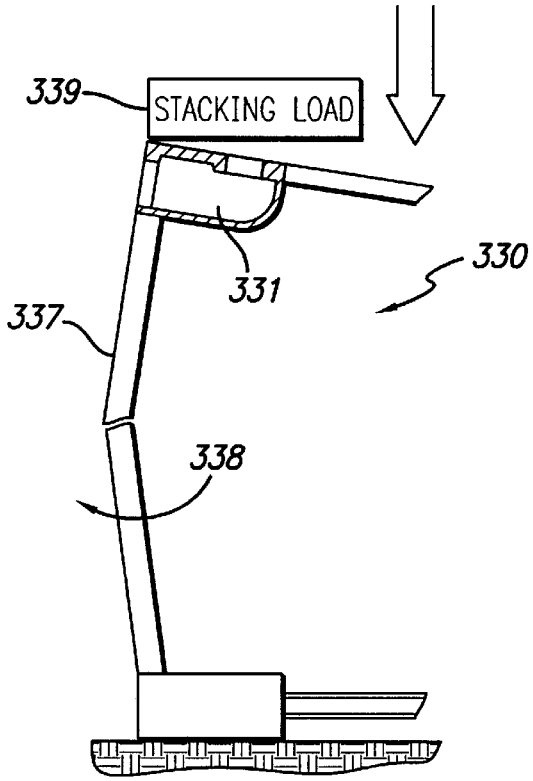
FIG. 17 PRIOR ART
FIG. 17 is a partial cross-sectional view of a known cargo container.

In contrast to corner fittings 10, FIG. 16 shows a known cargo container 330 having known fittings 331. Cargo container 330 has a lifting device 333 connecting to fittings 331 through apertures 335. Cargo container 330 is also approximately 102⅜ inches wide. However the center of the apertures 335 are positioned approximately 89 inches apart. In such a manner the center of the apertures 335 are positioned approximately 6 11/16 inches from each sidewall 337. Thereby when lifting device 333 lifts fitting 331, substantial stress and deformation occurs on the sidewall 337 due to angular force 338 as shown in FIG. 16. In a similar manner, when a stacking load 339 is positioned on the cargo container 330, an angular force 338 acts in an opposite direction on sidewall 337 as shown in FIG. 17. The stress and deformation acting on sidewall 337 may be substantial as the fitting extends further away from the sidewall 337.

Thus, by positioning the aperture 316 of fitting 10 more closely to the sidewall 318, stress and deformation on the side wall 318 is substantially reduced. Such stress and deformation are not only reduced when the cargo container 310 is being lifted, but is also reduced when stacking load is placed on top of the cargo container 310.

Figure 18:
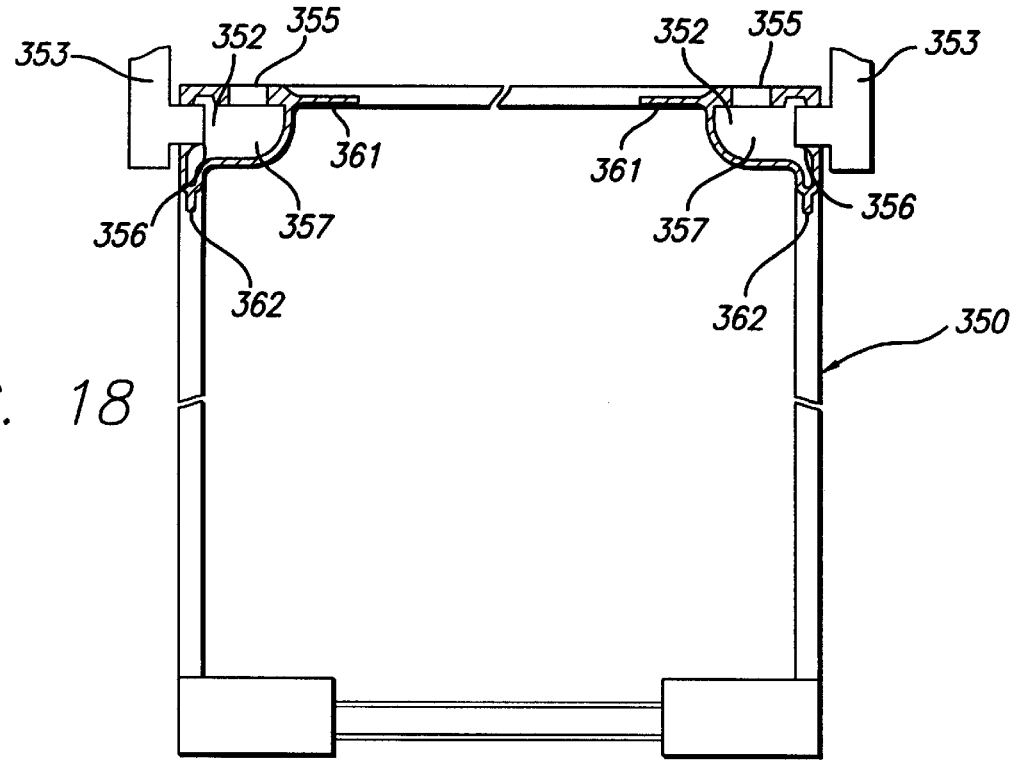
FIG. 18 is a partial cross-sectional view of a cargo container made in accordance with the present invention.

FIG. 18 shows another corner lift fitting 352 coupled to cargo container 350. The fittings 352 are positioned at the corners of the cargo container 350 such that a horizontal aperture 355 is centered approximately three inches from the cargo container's sidewall. It will be appreciated that the fitting may also be positioned at the end of the container or inboard from the end corners. Also, the fitting 352 has a vertical aperture 356. As shown in FIG. 18, lifting device 353 can be received through vertical aperture 356 for engaging and lifting the cargo container 350. In use, a portion of the lifting device 353 is received through the vertical aperture 356 and partially received into a chamber 357 in the fitting 352.

The fitting 352 has a horizontal welding flange 361 that is welded to the top of the cargo container 350. The fitting 352 also has a vertical welding flange 362 which is welded to the side wall of the cargo container 350. In such a manner the fitting 352 is securely coupled to the cargo container 350. It will be appreciated that other methods of securing the flanges to the cargo container may be used, for example, bolting or screwing.

Figure 19:
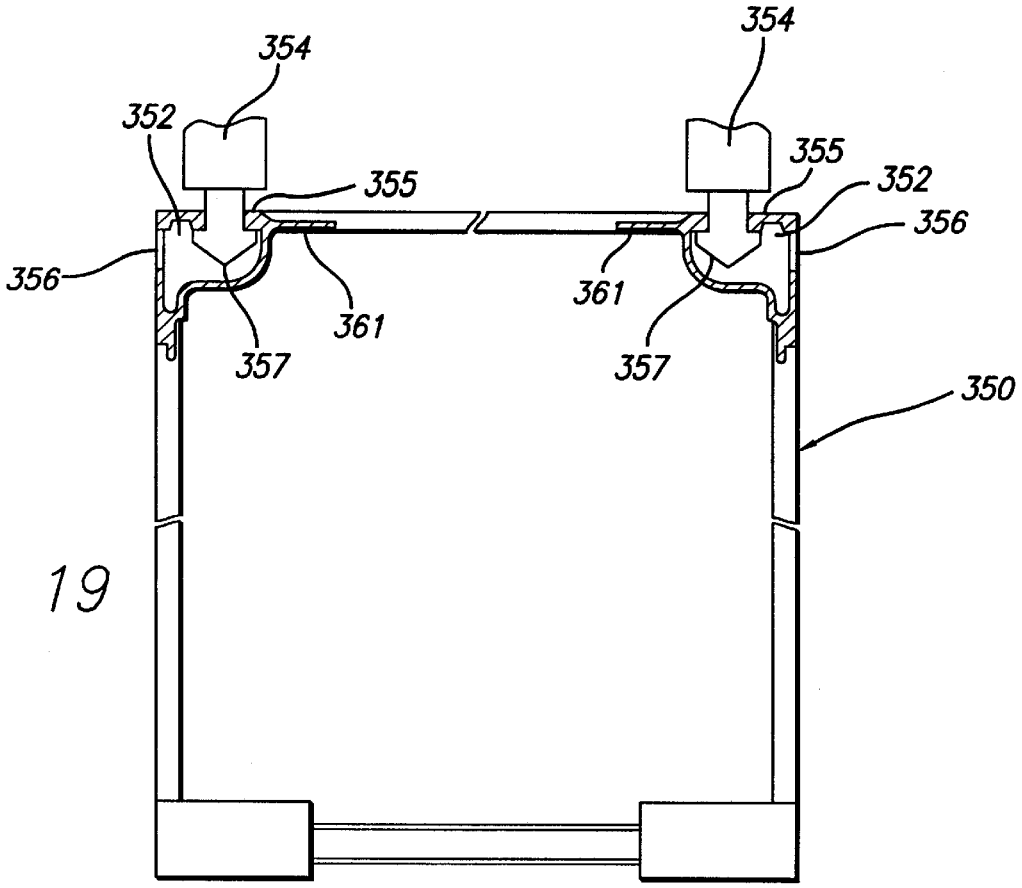
FIG. 19 is a partial cross-sectional view of a cargo container made in accordance with the present invention.
Figure 20:
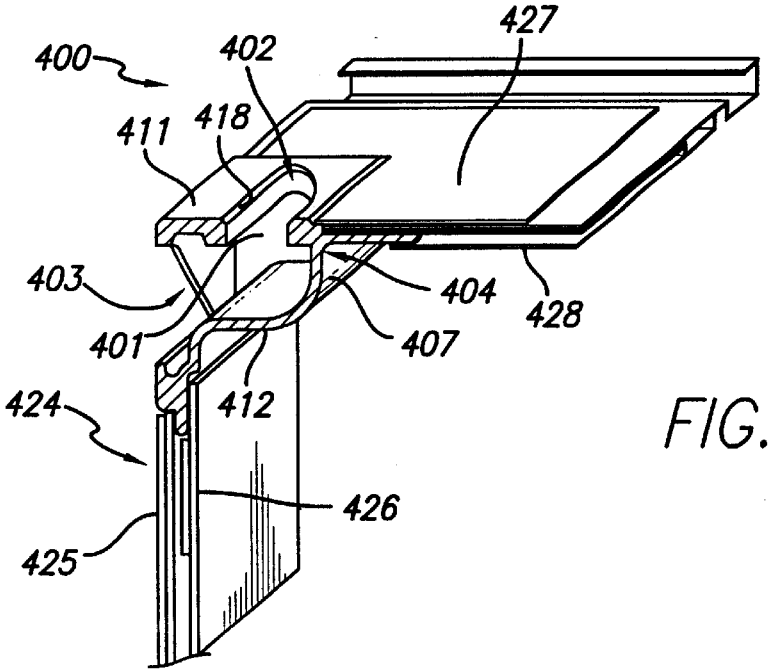
Figure 21:
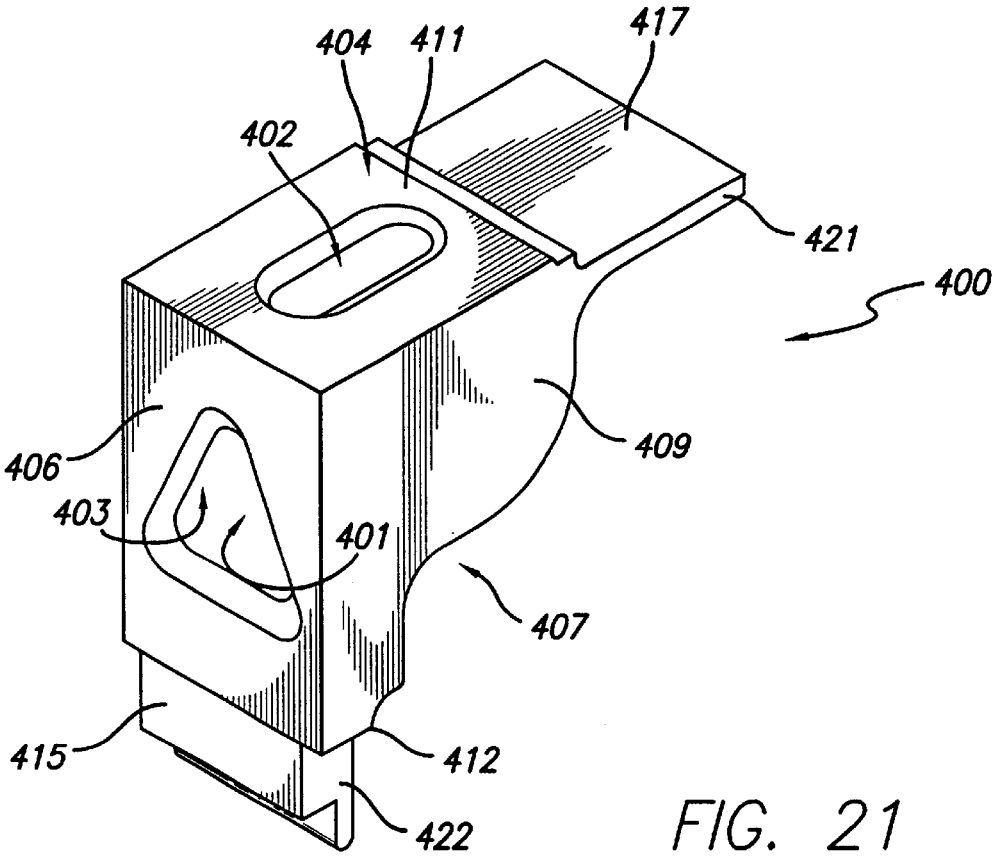
FIG. 21 is a perspective view of a lift support made in accordance with the present invention.

Fitting 352 enables lifting device 353 to engaged the cargo container 350 through vertical apertures 356. However, as shown in FIG. 19, lifting device 354 can also engage the fitting 352 through the horizontal aperture 355. As the horizontal aperture 355 is positioned only about three inches from the sidewall of the cargo container 350, forces acting to stress and deform the cargo container side walls are reduced.

FIGS. 20–24 show another corner lift fitting 400 made in accordance with the present invention. Although a described embodiment of the lift fitting 400 is constructed as an intermediate top corner lift fitting, it will be appreciated that lift fitting 400 may be constructed in a manner for use as any cargo container corner fitting. Lift fitting 400 is preferably cast in a single piece from a metallic material such as steel. It will be appreciated, however, that lift fitting 400 could also be assembled from component parts and from different materials. The lift fitting 400 attaches to a support 424 attached to the sidewall of the container and to the top wall 427, 428 of a cargo container. The support 424 has an outer wall 425 and an inner wall 426, In such a manner a horizontal aperture 402 is positioned centered approximately three inches from the outer wall 425. Also, the fitting 400 has a side aperture 403.

The fitting 400 is generally a block 404 with a horizontal aperture 402 and a vertical aperture 403 providing openings into a chamber 401 within the fitting 400. A portion of the lifting device can be received through the side aperture 403 for lifting the cargo container. Alternatively a lifting device may be received through the horizontal aperture 402 for lifting the cargo container. To assist in the insertion of the lifting device, an outer horizontal wall 411 has a tapered portion 418 leading to the horizontal aperture 402.

The fitting 400 has a horizontal extension 417 to be received between a top outer wall 427 of the cargo container and the top inner wall 428 of the cargo container. In a preferred embodiment the horizontal extension 417 is offset from the outer horizontal wall 411. This offset area is sized to receive a portion of the top outer wall 427 of the cargo container. In such a manner the outer horizontal wall 411 of the fitting 400 is positioned substantially planar with the outer wall 427 of the cargo container. Such positioning is not only structurally advantageous, but is also aesthetically pleasing.

The horizontal extension 417 is securely coupled to the cargo container. Preferably the horizontal extension 417 has a weld flange 421 that is welded to the inner container wall 428 or the outer container wall 427. It will be appreciated that the horizontal extension 417 can be secured to the cargo container using other securing methods such as bolting, screwing or riveting. In a preferred embodiment the welding flange is integrally formed with the fitting. However, it will be appreciated that the welding flange can be constructed from component parts and secured to the main body of the fitting using other securing methods.

The fitting 400 also has a vertical extension 415 that is received between the outer support wall 425 and the inner support wall 426. In a preferred embodiment the vertical extension 415 is offset from the vertical wall 406. This offset area is sized to receive a portion of the outer support wall 425 of the cargo container. Installed, the outer vertical wall 406 of the fitting is positioned substantially planar to the outer surface of the outer support wall 425. Such positioning is not only structurally advantageous, but is also aesthetically pleasing.

The vertical extension 415 is secured to the cargo container wall. Preferably the vertical extension 415 has a weld flange 422 that can be welded to one or both of the support walls 425,426. In a preferred embodiment the welding flanges are cast in a single piece with the fitting. It will be appreciated that the welding flanges could be constructed as separate component pieces and coupled to the fitting using standard attachment techniques such as welding, bolting, or screwing.

Although lift fitting 400 has been described as an intermediate top fitting, it will be appreciated that the inventive qualities of the fitting 400 can be used for other fittings, such as corner fittings.

Thus, it is seen that an apparatus to provide connection points on a cargo container for securing and lifting mechanisms is provided. One skilled in the art will appreciate that the present invention can be practiced by other than the preferred embodiment which is presented in the this description for the purposes of illustration and not limitation, and the present invention limited only by the claims that follow. It is noted that the equivalents for the particular embodiments discussed in this description may practice the invention as well.

What is claimed is:

1. A lift fitting for a cargo container comprising:

a body having a chamber for receiving a lifting device;

an outer horizontal wall on the body, the outer horizontal wall having a horizontal aperture into the chamber;

an inner horizontal wall on the body and placed oppositely the outer horizontal wall, with sidewalls attaching the outer horizontal wall to the inner horizontal wall;

an outer vertical wall on the body, the outer vertical wall having an outer face and a vertical aperture into the chamber, an extension member attached to the inner horizontal wall, said extension member having an inner extension portion and an outer extension portion, the inner extension portion and the outer extension portion being substantially planer, and the outer surface of the outer extension portion and an outer face of the outer vertical wall being flush and substantially planer; and wherein the inner extension portion and the outer extension portion cooperate to form at least one engageable step.

2. The fitting of claim 1 wherein the extension member is secured to a vertical support of the cargo container.

3. The fitting of claim 1 wherein the fitting is positioned inboard from the end corners of the cargo container.

4. The fitting of claim 1 wherein the fitting is positioned in an end corner of the cargo container.

5. The fitting of claim 1 wherein the horizontal aperture is sized to receive a lifting or coupling means.

6. The fitting of claim 1 wherein the vertical aperture is sized to receive a lifting or coupling means.

7. The fitting of claim 1 wherein the body is secured to a horizontal support of the cargo container by welding the sidewalls of the body to a horizontal support of the cargo container.

8. The fitting of claim 1 wherein the extension member is secured to a vertical support of the cargo container by welding said extension to a vertical support of the cargo container.

9. The fitting of claim 8 wherein said extension is further secured to a vertical support of said cargo container by at least one plug weld inserted into the extension and the vertical support.

10. The fitting of claim 1 wherein the step of the extension is adapted to receive a vertical support.

11. The fitting of claim 1 wherein the body and the extension are constructed of steel.

12. The fitting of claim 1 wherein the body and the extension are a one piece casting.

13. A method of lifting a cargo container comprising the steps of:

grappling at least one cargo container fitting with a mating lift assembly, wherein the fitting comprises:

a body having a chamber for receiving the lifting assembly;

an outer horizontal wall on the body, the outer horizontal wall having a horizontal aperture into the chamber;

an inner horizontal wall on the body and placed oppositely the outer horizontal wall, with sidewalls attaching the outer horizontal wall to the inner horizontal wall;

an outer vertical wall on the body, the outer vertical wall having an outer face and a vertical aperture into the chamber, an extension member attached to the inner horizontal wall, said extension member having an inner extension portion and an outer extension portion, the inner extension portion and the outer extension portion being substantially planer, and the outer surface of the outer extension portion and an outer face of the outer vertical wall being flush and substantially planer; and wherein the inner extension portion and the outer extension portion cooperate to form at least one engageable step; and lifting the cargo container.

14. A method of securing a cargo container comprising the steps of:

grappling at least one cargo container fitting with a mating securing assembly, the fitting comprising:

a body having a chamber for receiving the lifting assembly;

an outer horizontal wall on the body, the outer horizontal wall having a horizontal aperture into the chamber;

an inner horizontal wall on the body and placed oppositely the outer horizontal wall, with sidewalls attaching the outer horizontal wall to the inner horizontal wall;

an outer vertical wall on the body, the outer vertical wall having an outer face and a vertical aperture into the chamber, an extension member attached to the inner horizontal wall, said extension member having an inner extension portion and an outer extension portion, the inner extension portion and the outer extension portion being substantially planer, and the outer surface of the outer extension portion and an outer face of the outer vertical wall being flush and substantially planer; and wherein the inner extension portion and the outer extension portion cooperate to form at least one engageable step; and securing the cargo container.

15. The lift fitting of claim 1 where the horizontal aperture is centered approximately 3 inches from an outer surface of the outer vertical wall.

16. A lift fitting for a cargo container comprising:

a body having a chamber for receiving a lifting device;

an outer horizontal wall on the body, the outer horizontal wall having a horizontal aperture into the chamber;

an outer vertical wall on the body, the outer vertical wall having a vertical aperture into the chamber, a vertical extension extending from the outer vertical wall; and a horizontal extension extending from the outer horizontal wall.

17. The lift fitting of claim 16 where the vertical extension has a weld flange.

18. The lift fitting of claim 16 where the horizontal extension has a weld flange.

19. The lift fitting of claim 16 where the vertical extension is offset from the outer vertical wall, the offset providing an area for receiving a portion of a sidewall of the cargo container.

20. The lift fitting of claim 16 where the horizontal extension is offset from the outer horizontal wall, the offset providing an area for receiving a portion of a top wall of the cargo container.

21. A method of lifting a cargo container comprising the steps of:

grappling at least one cargo container fitting with a mating lift assembly, wherein the fitting comprises:

a body having a chamber for receiving a lifting device;

an outer horizontal wall on the body, the outer horizontal wall having a horizontal aperture into the chamber;

an outer vertical wall on the body, the outer vertical wall having a vertical aperture into the chamber, a vertical extension extending from the outer vertical wall; and a horizontal flange extending from the outer horizontal wall; and lifting the cargo container.

22. A cargo container, comprising:

a cargo box having opposing sidewalls spaced approximately 102⅜ inches apart;

at least 2 corner lift fittings, each fitting coupled to one of the opposing sidewalls and having a horizontal aperture sized to receive a lift device;

securing means for coupling each fitting to one of the sidewalls so that the horizontal aperture is centered approximately 3 inches from the sidewall; and whereby the centers of the apertures in the opposing fittings are spaced approximately 96⅜ inches apart.

* * * * *